US005476234A

United States Patent [19]

St. Pierre

[11] Patent Number: 5,476,234

[45] Date of Patent: Dec. 19, 1995

[54] VEHICLE-MOUNTED, WIRE DISPENSING APPARATUS

[76] Inventor: Bertin J. St. Pierre, 4021 Palm La., Ft. Myers, Fla. 33905

[21] Appl. No.: 165,640

[22] Filed: Dec. 13, 1993

[51] Int. Cl.[6] ..... B65H 75/42

[52] U.S. Cl. ..... 242/557

[58] Field of Search ..... 242/403, 557, 242/594.3, 594.4

[56] References Cited

U.S. PATENT DOCUMENTS

| | | | |
|---|---|---|---|
| 187,271 | 2/1877 | Haight | 242/594.3 |
| 1,474,873 | 11/1923 | Woodward | 242/594.3 |
| 2,789,778 | 4/1957 | Zogg et al. | 242/594.3 |
| 2,896,877 | 7/1959 | Vaughn | 242/557 |
| 2,914,270 | 11/1959 | Parker et al. | 242/403 |
| 3,048,348 | 8/1962 | Griffin | 242/403 |
| 3,072,358 | 1/1963 | Knapp | 242/594.3 |
| 3,650,492 | 3/1972 | Stum . | |
| 4,009,845 | 3/1977 | Santucci et al. . | |
| 4,208,021 | 6/1980 | Wall | 242/557 |
| 4,365,768 | 12/1982 | Woodruff . | |
| 4,854,521 | 8/1989 | Farnsworth | 242/594.3 |
| 5,060,882 | 10/1991 | Rousculp et al. . | |
| 5,163,634 | 11/1992 | Moon et al. | 242/557 |
| 5,186,410 | 2/1993 | Toews . | |
| 5,246,181 | 9/1993 | Straub et al. | 242/403 |

*Primary Examiner*—John P. Darling

[57] ABSTRACT

A vehicle-mounted, wire dispensing apparatus includes a horizontally oriented base plate and a spindle projecting vertically from the horizontally oriented base plate. A base plate support assembly supports the horizontally oriented base plate and the spindle. A first connector assembly connects the base plate support assembly to a vehicle, and a second connector assembly connects the spindle to the vehicle. The base plate support assembly includes horizontally oriented members underlying the horizontally oriented base plate. Vertically oriented members project upward from the horizontally oriented members. An elevated cross member connects the vertically oriented members, and brace members are connected between the elevated cross member and the horizontally oriented members. A separator assembly, supported by the spindle, may be used for separating a second wire reel from a first wire reel. The separator assembly includes an annular ting member capable of slipping over the spindle and a securing assembly, supported by the annular ring member, capable of securing the separator assembly at a selected position along the spindle.

3 Claims, 2 Drawing Sheets

FIG. 1
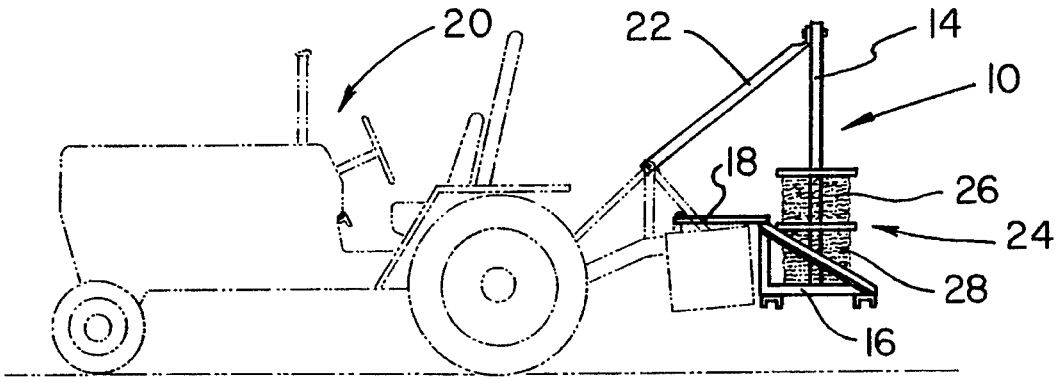
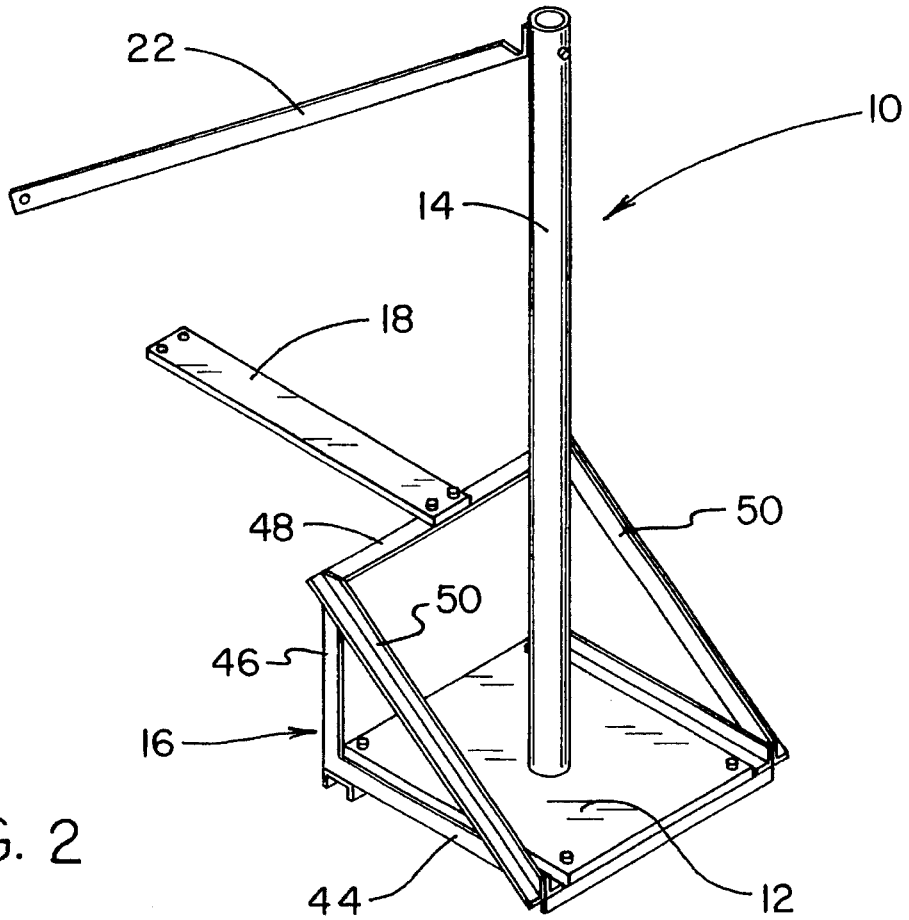
FIG. 2

FIG. 3
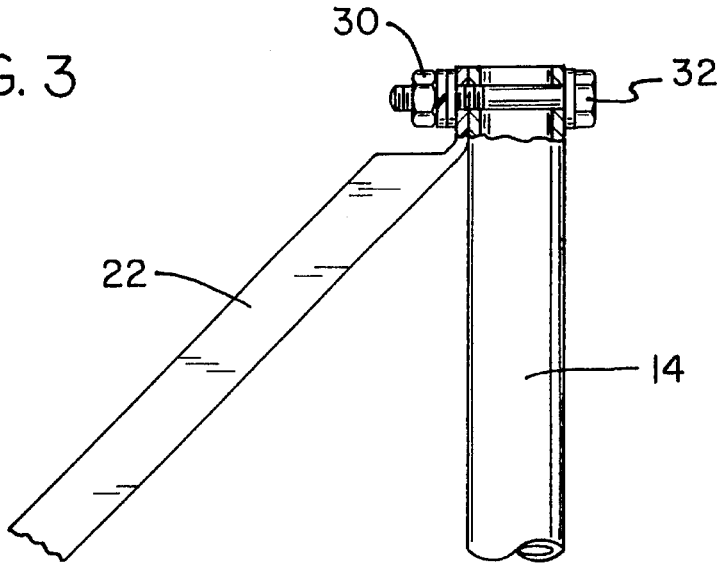
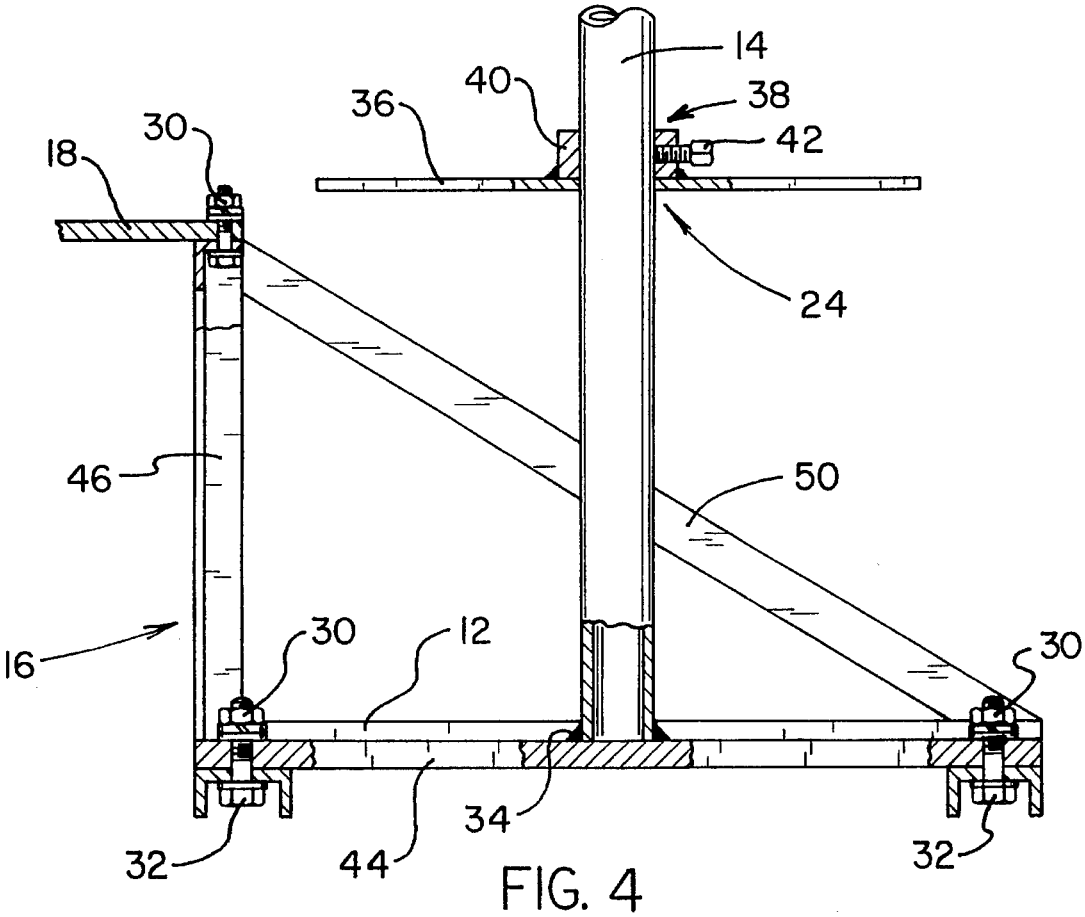
FIG. 4

VEHICLE-MOUNTED, WIRE DISPENSING APPARATUS

BACKGROUND OF THE INVENTION

1. Field of the Invention

The present invention relates generally to devices for dispensing wire from a reel, and, more particularly, to devices especially adapted for dispensing wire from a reel with the aid of a motor vehicle.

2. Description of the Prior Art

Wire of a variety of types is retained on a reel and dispensed therefrom. For dispensing large quantities of wire over long distances, motor vehicles are employed to aid in dispensing the wire. Throughout the years, a number of innovations have been developed relating to dispensing wire from reels, and the following U.S. patents are representative of some of those innovations: U.S. Pat. Nos. 3,650,492; 4,009,845; 4,365,768; 5,060,882; and 5,186,410.

More specifically, U.S. Pat. No. 3,650,492 discloses a separate trailer for dispensing wire from a reel. The separate trailer is pulled by a motor vehicle. The reel of wire is oriented in a horizontal direction and requires a pair of bearings for supporting the horizontally oriented reel. The use of a separate trailer has a number of undesirable aspects. A separate trailer is a large, space-consuming, and expensive device. In this respect, it would be desirable if a wire dispensing device were provided which did not use a separate trailer for carrying the reel of wire.

U.S. Pat. Nos. 4,009,845, 4,365,768, and 5,060,882 share a common characteristic in that a wire reel is oriented in a horizontal orientation. As such, a pair of bearings must be used where respective bearings support respective ends of the reel. For proper operation, the pair of bearings must be maintained, lubricated, and perhaps replaced at appropriate intervals. In this respect, it would be desirable if a wire dispensing device were provided which did not employ a pair of bearings.

U.S. Pat. No. 5,186,410 discloses a hand-cranked wire reel mechanism that operates on a reel that is supported in a horizontal orientation.

Still other features would be desirable in a vehicle-mounted, wire dispensing apparatus. For example, it would be desirable if a wire dispensing apparatus could carry a plurality of reels.

As mentioned above, many wire dispensing devices include pairs of bearings. The bearings are moving parts that move doing the dispensing operation. As such, moving parts have a strong tendency to wear and require periodic lubrication. To avoid the complications that result from moving parts, it would be desirable if a vehicle-mounted, wire dispensing apparatus were provided that did not employ moving parts.

The devices disclosed in the patents cited above require special manufacturing techniques and employ specially fabricated metal parts. Such special requirements cause costs to be high and availability low. In this respect, it would be desirable if a wire dispensing device were provided which were readily fabricated from readily available, off-the-shelf components.

Many of the devices disclosed in the patents cited above are large and bulky and require considerable amounts of space for their storage when not in use. They are complex devices and are not readily disassembled for storage and reassembled for use. In this respect, it would be desirable if a wire dispensing device were provided which is readily disassembled for storage and reassembled for use.

Thus, while the foregoing body of prior art indicates it to be well known to use vehicle-mounted, wire dispensing devices, the prior art described above does not teach or suggest a vehicle-mounted, wire dispensing apparatus which has the following combination of desirable features: (1) does not require a separate trailer for carrying the reel of wire; (2) does not employ a pair of bearings that move as wire is being dispensed; (3) can carry a plurality of reels; (4) does not require the employment of moving parts; (5) is readily fabricated from readily available, off-the-shelf components; and (6) is readily disassembled for storage and reassembled for use. The foregoing desired characteristics are provided by the unique vehicle-mounted, wire dispensing apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved vehicle-mounted, wire dispensing apparatus which includes a horizontally oriented base plate and a spindle projecting vertically from the horizontally oriented base plate. A base plate support assembly supports the horizontally oriented base plate and the spindle. A first connector assembly connects the base plate support assembly to a vehicle, and a second connector assembly connects the spindle to the vehicle.

The base plate support assembly includes horizontally oriented members underlying the horizontally oriented base plate. Vertically oriented members project upward from the horizontally oriented members. An elevated cross member connects the vertically oriented members, and brace members are connected between the elevated cross member and the horizontally oriented members.

A separator assembly, supported by the spindle, may be used for separating a second wire reel from a first wire reel. The separator assembly includes an annular ring member capable of slipping over the spindle and a securing assembly, supported by the annular ring member, capable of securing the separator assembly at a selected position along the spindle. The securing assembly includes a collar attached to the annular ring member and a threaded lock bolt capable of screwing into a complementarily threaded hole in the collar, for exerting a clamping pressure on the spindle when the separator assembly is positioned at a selected position along the spindle.

The first connector assembly includes a straight beam which is connected at a first end to the base plate support assembly and at a second end to the vehicle.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved vehicle-mounted, wire dispensing apparatus which has all of the advantages of the prior art and none of the disadvantages.

It is another object of the present invention to provide a new and improved vehicle-mounted, wire dispensing apparatus which may be easily and efficiently manufactured and marketed.

It is a further object of the present invention to provide a new and improved vehicle-mounted, wire dispensing apparatus which is of durable and reliable construction.

An even further object of the present invention is to provide a new and improved vehicle-mounted, wire dispensing apparatus which is susceptible of a low cost of manufacture with regard to both materials and labor, and which accordingly is then susceptible of low prices of sale to the consuming public, thereby making such vehicle-mounted, wire dispensing apparatus available to the buying public.

Still yet a further object of the present invention is to provide a new and improved vehicle-mounted, wire dispensing apparatus which does not require a separate trailer for carrying the reel of wire.

Still another object of the present invention is to provide a new and improved vehicle-mounted, wire dispensing apparatus that does not employ a pair of bearings that move as wire is being dispensed.

Even another object of the present invention is to provide a new and improved vehicle-mounted, wire dispensing apparatus that can carry a plurality of reels.

Yet another object of the present invention is to provide a new and improved vehicle-mounted, wire dispensing apparatus that does not require the employment of moving parts.

Still another object of the present invention is to provide a new and improved vehicle-mounted, wire dispensing apparatus which is readily fabricated from readily available, off-the-shelf components.

An even further object of the present invention is to provide a new and improved vehicle-mounted, wire dispensing apparatus that is readily disassembled for storage and reassembled for use.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a preferred embodiment of the vehicle-mounted, wire dispensing apparatus of the invention that is mounted on tractor.

FIG. 2 is an enlarged perspective view of the embodiment of the invention shown in FIG. 1 that is removed from the tractor and that does not include separator assemblies for separating plural reels of wire.

FIG. 3 is an enlarged side view, shown partially broken away, of the top portion of the embodiment of the invention shown in FIG. 2.

FIG. 4 is an enlarged side view, shown partially broken away, of the bottom portion of the embodiment of the invention shown in FIG. 2, also including a separator assembly.

DESCRIPTION OF THE PREFERRED EMBODIMENT

With reference to the drawings, a new and improved vehicle-mounted, wire dispensing apparatus embodying the principles and concepts of the present invention will be described.

Turning to FIGS. 1–4, there is shown an exemplary embodiment of the vehicle-mounted, wire dispensing apparatus of the invention generally designated by reference numeral 10. In its preferred form, vehicle-mounted, wire dispensing apparatus 10 includes a horizontally oriented base plate 12 and a spindle 14 projecting vertically from the horizontally oriented base plate 12. The spindle 14 is connected to the horizontally oriented base plate 12 by a weld 34. Base plate support assembly 16 supports the horizontally oriented base plate 12 and the spindle 14. A first connector assembly 18 connects the base plate support assembly 16 to a vehicle 20, and a second connector assembly 22 connects the spindle 14 to the vehicle 20. In FIG. 1, the vehicle 20 is a tractor.

The base plate support assembly 16 includes horizontally oriented members 44 underlying the horizontally oriented base plate 12. Vertically oriented members 46 project upward from the horizontally oriented members 44. An elevated cross member 48 connects the vertically oriented members 46, and brace members 50 are connected between the elevated cross member 48 and the horizontally oriented members 44.

As shown in FIG. 4, an unlabeled first transverse member extends substantially orthogonally between the horizontally oriented members 44 proximal to the juncture of the vertically oriented members 46 and the horizontally oriented members. A second transverse member (not labeled) similarly extends substantially orthogonally between the horizontally oriented members distal of the juncture of the vertically oriented members 46 and the horizontally oriented members 44. A plurality of bolts 32 are directed through both the base plate 12 and the transverse members to removably couple the base plate to the transverse members.

A separator assembly 24, supported by the spindle 14, is used for separating a second reel 26 from a first reel 28. The separator assembly 24 includes an annular ring member 36 capable of slipping over the spindle 14 and a securing assembly 38, supported by the annular ring member 36, capable of securing the separator assembly 24 at a selected position along the spindle 14. The securing assembly 38 includes a collar 40 attached to the annular ring member 36 and a threaded lock bolt 42 capable of screwing into a complementarily threaded hole in the collar 40, for exerting a clamping pressure on the spindle 14 when the separator assembly 24 is positioned at a selected position along the spindle 14.

The first connector assembly 18 includes a straight beam which is connected at a first end to the base plate support assembly 16 and at a second end to the vehicle 20. As shown in FIG. 1, the vehicle 20 is a tractor, and the entire vehicle-mounted, wire dispensing apparatus 10 of the invention is supported by the tractor.

As shown in greater detail in FIGS. 3 and 4, the horizontally oriented base plate 12 is connected to the base plate support assembly 16 by readily attachable and removable sets of nuts 30 and bolts 32. In addition, the first connector assembly 18 is connected to the base plate support assembly 16 by nuts 30 and bolts 32.

In use, the second connector assembly 22 is connected to one portion of the tractor 20, and the first connector assembly 18 is connected to another portion of the tractor 20. In this way, the vehicle-mounted, wire dispensing apparatus 10 of the invention is connected to and supported by the tractor 20. To position a first reel 28 on the horizontally oriented base plate 12, the second connector assembly 22 is temporarily disconnected from the top of the spindle 14. The first reel 28 is then lowered on the spindle 14 to a position on the horizontally oriented base plate 12. The separator assembly 24 can then be lowered on the spindle 14 to a position above the first reel 28. The separator assembly 24 is then secured into its selected position along the spindle 14 by employing the securing assembly 38. Then a second reel 26 can be lowered on the spindle 14 to rest upon the annular ring member 36 of the separator assembly 24. Then the second connector assembly 22 is reconnected to the top of the spindle 14. The result of this loading procedure is shown in FIG. 1.

As wire is dispensed from the first reel 28, the first reel 28 rotates around the spindle 14 and lies on the horizontally oriented base plate 12. In essence, the horizontally oriented base plate 12 serves as a single flat bearing for the rotating first reel 28. As wire is dispensed from the second reel 26, the second reel 26 rotates around the spindle 14 and lies on the horizontally oriented annular ring member 36 of the separator assembly 24. In essence, the horizontally oriented annular ring member 36 serves as a single flat bearing for the rotating second reel 26.

The components of the vehicle-mounted, wire dispensing apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved vehicle-mounted, wire dispensing apparatus that is low in cost, relatively simple in design and operation, and which may advantageously be used without requiring a separate trailer for carrying the reel of wire. With the invention, a vehicle-mounted, wire dispensing apparatus is provided which does not employ a pair of bearings that move as wire is being dispensed. With the invention, a vehicle-mounted, wire dispensing apparatus is provided which can carry a plurality of reels. With the invention, a vehicle-mounted, wire dispensing apparatus is provided which does not require the employment of moving parts. With the invention, a vehicle-mounted, wire dispensing apparatus is provided which is readily fabricated from readily available, off-the-shelf components. With the invention, a vehicle-mounted, wire dispensing apparatus is provided which is readily disassembled for storage and reassembled for use.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A vehicle-mounted wire dispensing apparatus comprising:

a vehicle;

a horizontally oriented base plate;

a spindle fixedly secured to and projecting vertically upwardly from the horizontally oriented base plate;

a base plate support assembly supporting the horizontally oriented base plate and the spindle, the base plate support assembly comprising a first horizontally oriented member extending at least partially beneath and along a first lateral edge of the base plate, and a second horizontally oriented member extending in a substantially spaced and parallel orientation relative to the first horizontally oriented member and at least partially beneath and along a second lateral edge of the base plate; a first vertically oriented member extending substantially orthogonally upwardly from an interior end of the first horizontally oriented member, and a second vertically oriented member extending substantially orthogonally upwardly from an interior end of the second horizontally oriented member; an elevated cross member extending substantially orthogonally between upper ends of the vertically oriented members distal from a juncture of the vertically oriented members and the horizontally oriented members; a first brace member extending between an exterior end of the first horizontally oriented member distal from the juncture and the upper end of the first vertically oriented member, and a second brace member extending between an exterior end of the second horizontally oriented member distal from the juncture and the upper end of the second vertically oriented member; a first transverse member extending substantially orthogonally between the horizontally oriented members proximal to the juncture of the vertically oriented members and the horizontally oriented members; a second transverse member extending substantially orthogonally between the horizontally oriented members distal of the juncture of the vertically oriented members and the horizontally oriented members; and a plurality of bolts directed through base plate and the transverse members to removably couple the base plate to the transverse members;

a first connector assembly extending between the base plate support assembly and the vehicle, the first connector assembly including a straight beam connected at a first end thereof to the elevated cross member of the base plate support assembly and at a second end of the straight beam to the vehicle;

and, a second connector assembly removably coupled to the spindle and extending between the spindle and the vehicle.

2. The vehicle-mounted wire dispensing apparatus of claim 1, wherein the straight beam of the first connector assembly is removably connected to the elevated cross member of the base plate support assembly by a plurality of further bolts extending therebetween.

3. The vehicle-mounted wire dispensing apparatus of claim 2, and further comprising a first reel concentrically positioned about the spindle and resting on the horizontally oriented base plate; a separator assembly concentrically positioned about the spindle, the separator assembly comprising an annular ring member concentrically positioned about the spindle and a securing assembly mounted to the annular ring member for securing the separator assembly in a predetermined position along the spindle, the securing assembly including a collar attached to the annular ring member and a threaded lock bolt directed through the collar and engaging the spindle; and a second reel concentrically positioned about the spindle and resting on the horizontally oriented annular ring member of the separator assembly.

* * * * *